US006767301B2

(12) United States Patent
Hu

(10) Patent No.: US 6,767,301 B2
(45) Date of Patent: Jul. 27, 2004

(54) ENHANCING INNER STRUCTURE OF INFLATING BALL WITH OUTER LAYER

(76) Inventor: Liang-Fa Hu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/201,819

(22) Filed: Jul. 25, 2002

(65) Prior Publication Data

US 2004/0018902 A1 Jan. 29, 2004

(51) Int. Cl.[7] ..... A63B 41/08
(52) U.S. Cl. ..... 473/605
(58) Field of Search ..... 473/603, 604, 473/605, 598, 599, 600, 601, 6.02

(56) References Cited

U.S. PATENT DOCUMENTS 6,390,941 B1 * 5/2002 Ou ..... 473/605
6,506,135 B2 * 1/2003 Ou ..... 473/604
6,517,471 B2 * 2/2003 Chen ..... 482/148
6,544,133 B2 * 4/2003 Ou ..... 473/604

* cited by examiner

*Primary Examiner*—Steven Wong

(57) ABSTRACT

An enhancing inner structure of an inflating ball with an outer layer has a round inflated inner bladder by inflating an inflatable inner bladder which is processed in advance by a separating agent. Then the inflated inner bladder is wound by fabrics to form with an enhancing layer. Then, the enhancing layer is enclosed by a plurality of piece-like structures to be as an outer layer. The fabrics are mixed with foamed soft sponge rubber. Then the outer layer is seamed. Then the whole ball structure is heated. Since the foaming material on the outer surface of the enhancing layer is non-viscous in normal temperatures, and the inner bladder is processed in advance with a separating agent; thereby, when the air in the bladder is released; the inner layer and the enhancing layer will separate naturally.

1 Claim, 3 Drawing Sheets

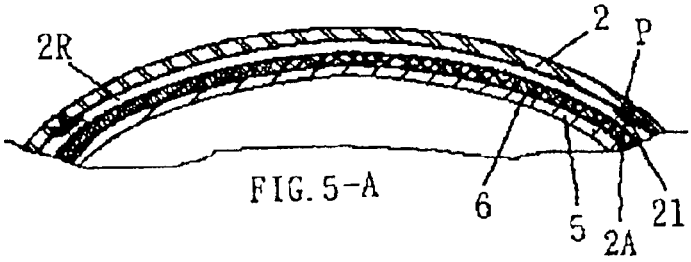
FIG. 5-A
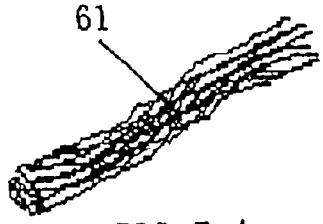
FIG. 7-A
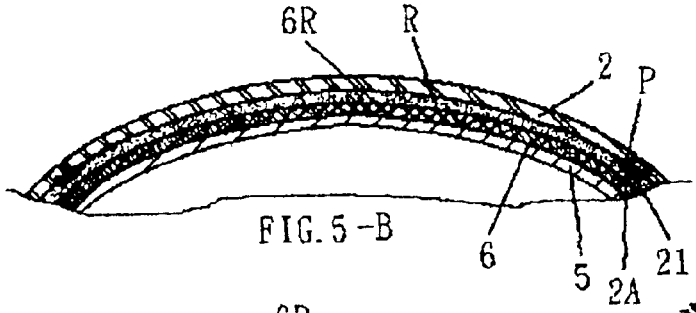
FIG. 5-B
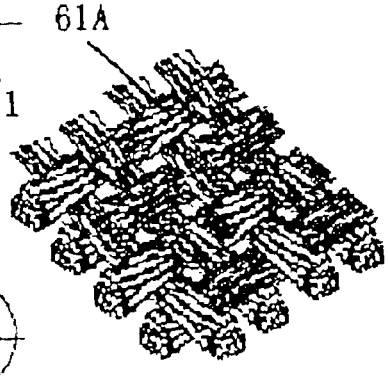
FIG. 7-B
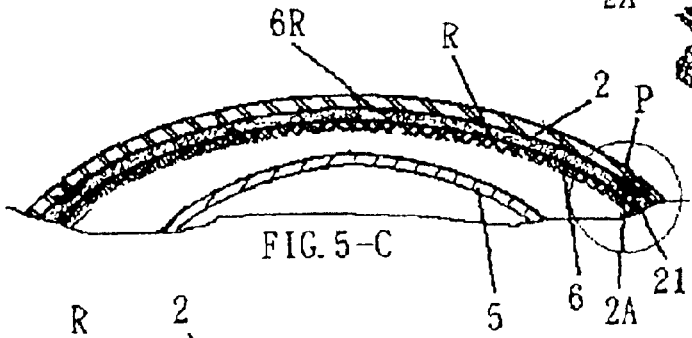
FIG. 5-C
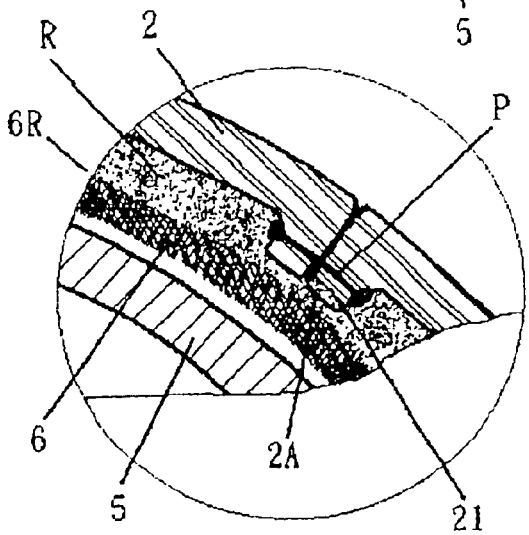
FIG. 6
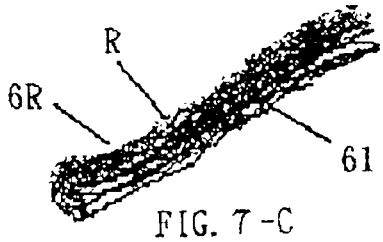
FIG. 7-C
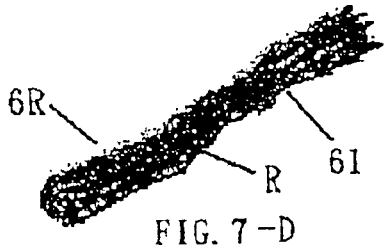
FIG. 7-D

ENHANCING INNER STRUCTURE OF INFLATING BALL WITH OUTER LAYER

FIELD OF THE INVENTION

The present invention relates to ball structures, and particularly to an enhancing inner structure of an inflating ball with an outer layer; wherein the foaming material will form with a uniform elastic clamping layer. Thus, the whole surface of the ball has uniform elastic strength.

BACKGROUND OF THE INVENTION

There are several structures used in inflatable ball which are required to have a uniform surface and a strong structure. These balls are used in the field of such as footballs, as illustrated in FIG. 1. These balls are enclosed with a plurality of outer pieces. A plurality of seaming lines P are formed as the pieces are seamed together. The edges of the pieces are formed with folding portions 21. Thereby, strip edges 2A are formed. As an inner bladder is placed within the ball forming by a plurality of pieces, the bottom of the outer layer 2 will form with space 2R due to the edge 2A. Thereby, the inner bladder 3 can not completely adhere to the outer layer 2 and thus the strength and elasticity of the ball will not be uniform.

To overcome above problem, the U.S. Pat. No. 5,772,545, "Sportsball and manufacturing method thereof" discloses a structure, referring to FIG. 2, in that the inner surface of each piece of the outer layer 2 is added with a pad 4 which has a size smaller than the piece so that the width of the pad 4 can compensate the spaces generated from the strip edge 2A. The pad 4 may be made of EVA or other elastic plastics. Thereby, this structure can improve above mentioned defect and cause a uniform and elastic ball. However, the manufacturing process is complex and thus the cost is high. Moreover, the lateral gaps 2S still exists so that the inner bladder 3A enclosing with enhancing layer H cannot completely adhere to the outer layer 2. This is the defect of the prior art.

SUMMARY OF THE INVENTION

Accordingly, the primary object of the present invention is to provide an enhancing inner structure of an inflating ball with an outer layer. The structure has a round inflated inner bladder by inflating an inflatable inner bladder which is processed in advance by a separating agent. A plurality of fabrics is wound around the inflated bladder so as to form with an enhancing layer. Then, a plurality of piece-like structures are enclosed around the enhancing layer to be as an outer layer. The fabrics are mixed with foamed soft sponge rubber. Then the outer layer is seamed. Then the whole ball structure is heated. Since the foaming material on the outer surface of the enhancing layer is non-viscous in normal temperatures, and the inner bladder is processed in advance with a separating agent; thereby, when the air in the bladder is released; the inner layer and the enhancing layer will separate naturally.

Another object of the present invention is to provide an enhancing inner structure of an inflating ball with an outer layer; wherein the foaming material will form as a uniform elastic clamping layer. Thus, the whole surface of the ball has uniform elastic strength.

The various objects and advantages of the present invention will be more readily understood from the following detailed description when read in conjunction with the appended drawing.

BRIEF DESCRIPTION OF THE DRAWINGS

FIG. 5A is a partial enlarged view of the present invention (nor foaming).

FIG. 5B is a partial enlarged view of the present invention (foamed).

FIG. 5C is a partial enlarged view of the present invention (nor foaming).

FIG. 6 is a partial cross section view of the present invention (foamed).

FIG. 7A is an enlarged view of the thread bundle of the present invention without experiencing adhering or soaking process.

FIG. 7B is an enlarged view of the fabric layer of the present invention without experiencing adhering or soaking process.

FIG. 7C is an enlarged view of thee threads of the present invention with adhering process through foamed soft sponge rubber.

FIG. 7D is an enlarged view of the threads of the present invention with soaking process by being soaked in foamed soft sponge rubber.

DETAILED DESCRIPTION OF THE PREFERRED EMBODIMENTS

Figure 1:
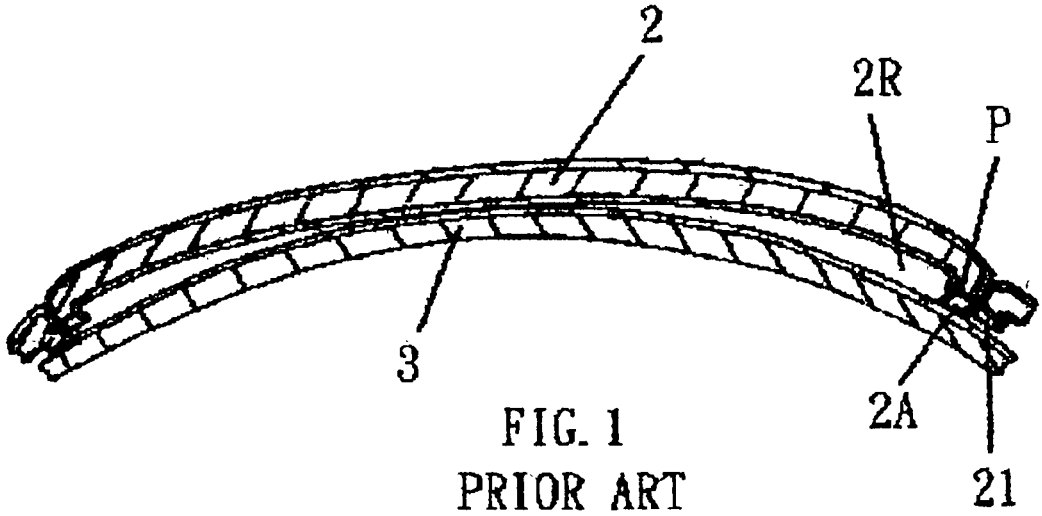
FIG. 1 PRIOR ART
FIG. 1 is a cross section view showing the prior art balloon with a seamed outer layer.
Figure 2:
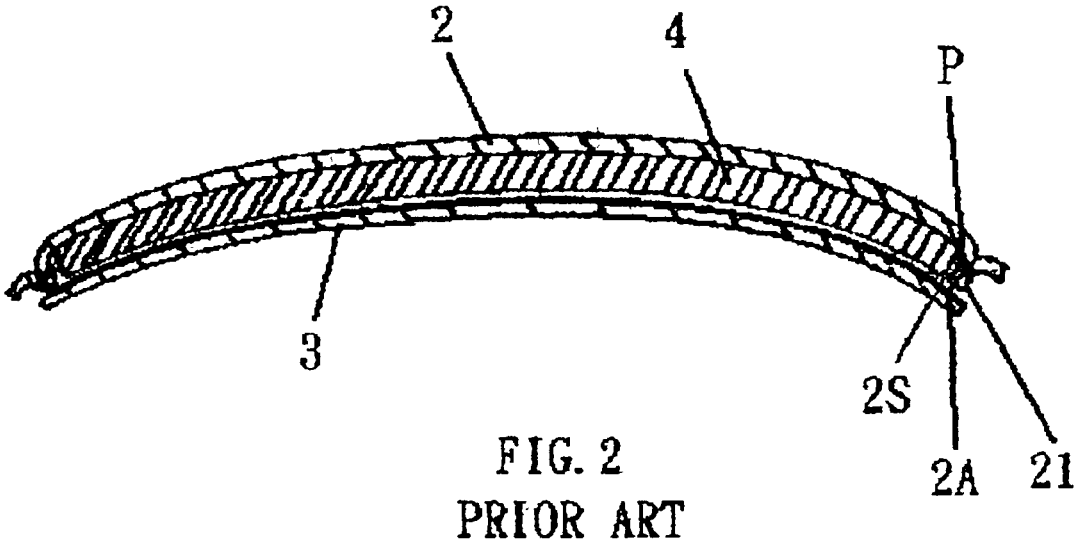
FIG. 2 PRIOR ART
FIG. 2 is a cross section view of a prior art structure.
Figures 3, 4:
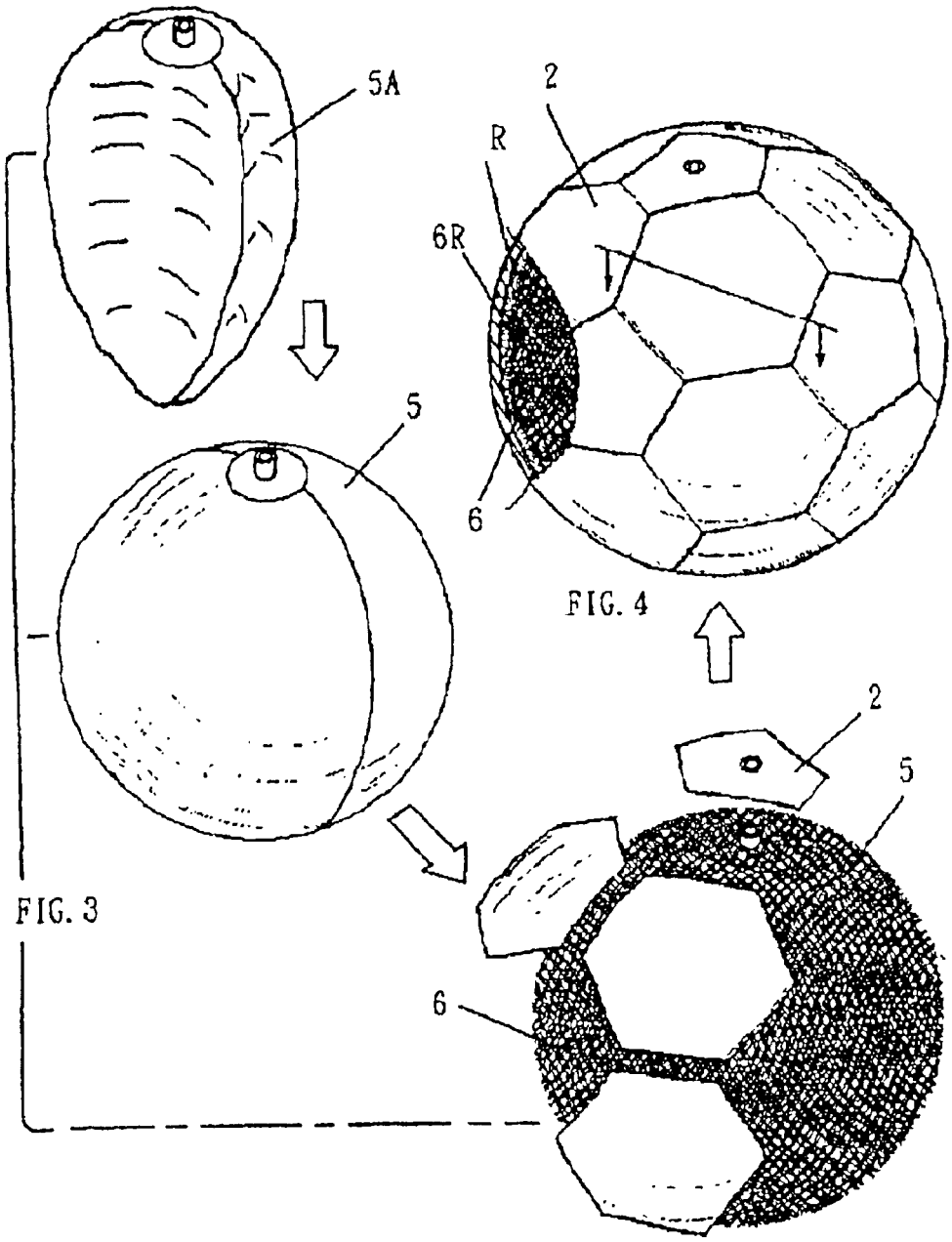
FIG. 3 is an exploded perspective view of the present invention.
FIG. 4 is a partial cross section view of the ball structure of the present invention.

Referring to FIGS. 1 and 4, a preferred embodiment of the present invention is illustrated.

In the present invention, an inflatable inner bladder 5A is inflated as a round bladder 5. Then a plurality of threads 6R are wound around the inflated bladder 5 so as to form with an enhancing layer 6. Then a plurality of piece-like structures are enclosed around the enhancing layer 6 to be as an outer layer 2 (referring to FIG. 4). The feature of the present invention will be described in the following (referring to FIGS. 5A, 5B and 6).

The thread 6R (referring to FIGS. 7A, 7B and 7C) are foamed sponge rubber R processed by adhering or soaking process.

In the adhering process, the bare thread bundle 61 (referring to FIG. 7A) or bare fabric layer 61A (referring to FIG. 7B) pass through a tank filled with foamed soft sponge rubber R so as to have adhering ability on the surface thereof (referring to FIG. 7C). This process is especially suitable for rubber materials with high foaming property.

For the soaking process, the bare thread bundle 61 (referring to FIG. 7A) or bare fabric layer 61A (referring to FIG. 7B) are soaked in a tank filled with foamed soft sponge rubber R to have adhering ability on the whole thread bundle (including interior thereof) or the fabric layer (referring to FIG. 7C) and then the thread bundle or the fabric layer is fed to a thread supply device. This process is especially suitable for rubber materials with low foaming property.

After the outer layer 2 is seamed (referring to FIG. 5A), the whole ball structure is heated. Then the foaming material R foams in the interior of the outer layer 2 (referring to FIG. 5B). The foaming process will not occur at the strip edges 2A along the edges of the folding portion 21 for connection (the seaming line). A foaming material is filled between the lower surface of the outer layer 2 and the enhancing layer 6. Thereby, the spaces between the seamed edge 2A of the outer layer 2 can be filled with foaming material completely so that the foaming material will form as a uniform elastic clamping layer (referring to FIG. 6). Thus, the whole surface of the ball has uniform elastic strength.

Further, the foaming rubber R on the surface of the enhancing layer 6 is viscous as it is heated. Thus the threads and fabrics can be fastened. Thereby, the enhancing layer 6 will be strengthened and the enhancing layer 6 can be firmly secured to the outer layer 2 (referring to FIGS. 5B and 5C).

However, since the foaming material R on the outer surface of the enhancing layer 6 is non-viscous in normal temperatures, and the inner bladder 5 is processed in advance with a separating agent. Thereby, when the pressure in the inner bladder 5 is released (referring to inner bladder 5A in FIG. 5C). The inner bladder 5 and the enhancing layer 6 will separate naturally. Thus, the inflated bladder 5 or pressure-released bladder 5A has no bad effect to the flatness of the outer layer 2 or will not deform the outer layer 2.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An enhancing inner structure of an inflating ball with an outer layer; the structure having a round inflated inner bladder; an enhancing layer enclosing the round inflated inner bladder; a plurality of piece-like structures enclosing the enhancing layer to be an outer layer; the enhancing layer being formed by fabrics; characterized in that:

the inner bladder is processed in advance by a separating agent;

the fabrics are mixed with foamed soft sponge rubber; the foamed soft sponge rubber is viscous as heated and is not viscous in lower temperatures; and spaces between a seamed edge of an interior of the outer layer are filled with foaming material completely so that the foamed soft sponge rubber will form with the foaming material as a uniform elastic clamping layer;

wherein since the foaming material on the outer surface of the enhancing layer is non-viscous in lower temperatures, and the inner bladder is processed in advance with a separating agent when the air in the bladder is released the inner layer and the enhancing layer will separate.

* * * * *